US005377518A

United States Patent [19]

Abbott

[11] Patent Number: 5,377,518

[45] Date of Patent: Jan. 3, 1995

[54] METHOD AND APPARATUS FOR FORMING EXTRUDED METAL TUBES

[75] Inventor: Joe L. Abbott, Cumberland, R.I.

[73] Assignee: Enviro Pac International, Llc., Lincoln, R.I.

[21] Appl. No.: 65,943

[22] Filed: May 21, 1993

[51] Int. Cl.[6] ..... B21C 23/18

[52] U.S. Cl. ..... 72/267

[58] Field of Search ..... 72/264, 267

[56] References Cited

U.S. PATENT DOCUMENTS

| | | | |
|---|---|---|---|
| 1,444,270 | 2/1923 | Pinchart-Deny et al. | 72/267 |
| 2,904,173 | 9/1959 | Braun et al. | 72/267 |
| 2,913,107 | 11/1959 | Biginelli | 72/267 |
| 3,430,593 | 3/1969 | Stolle et al. | 72/267 |

*Primary Examiner*—Lowell A. Larson

*Attorney, Agent, or Firm*—Weingarten, Schurgin, Gagnebin & Hayes

[57] ABSTRACT

An apparatus for forming an extruded cylindrical closed-ended metal tube having a flat end wall and an integrally formed projection on the end wall includes a die having a recess formed therein, the die having a configuration which corresponds to the terminal end portion of the desired tube and including a cavity which corresponds to the desired projection. The apparatus further includes a punch which is receivable in the die, and includes an end wall having a peripheral portion which extends angularly outwardly at an angle of between approximately 10° and 20° relative to a plane which is perpendicular to the longitudinal axis of the die. The apparatus is operative by placing an extrudable metal disc in the recess in the die and advancing the punch into the recess with sufficient force to extrude metal from the disc into the cavity and also between the punch and the die to form the desired tube.

9 Claims, 2 Drawing Sheets

METHOD AND APPARATUS FOR FORMING EXTRUDED METAL TUBES

BACKGROUND AND SUMMARY OF THE INVENTION

The instant invention relates to the formation of extruded metal containers and more particularly to a method and apparatus for forming an extruded metal tube having a substantially flat, closed, end wall and a projection which extends integrally from the end wall.

It is generally recognized that it is possible to effectively extrude certain metals, such as aluminum, to form relatively thin-walled tubular elements and canisters for use in packaging various types of goods. In this regard, extruded tubular metal containers have been effectively utilized for a number of years for packaging various materials, including epoxies and other adhesives, toothpaste, and certain food products. Extruded metal tubes having slightly greater wall thicknesses have also been effectively utilized for containing and packaging various pressurized materials, including propane, butane, and various tear gasses.

The most widely accepted technique for forming thin walled tubular members of the above type is to assemble a predetermined quantity of a solid extrudable metal in a die and to then apply a punch to the metal in the die with a sufficient force to liquify the metal so that it is extruded through the areas between the punch and the die. In this regard, a die utilized in an operation of this type generally comprises a pair of die elements which cooperate to define a substantially closed-ended cylindrical recess. The first of these die elements is generally adapted to define the substantially closed terminal end portions of the recess, and it may include a vent opening for venting gases which are generated during an extrusion operation. The second of these die elements is generally formed in a ring-like configuration and adapted to be received on the first die element so that it provides a tubular extension of the portions of the recess formed in the first die element. The punch of a punch and die assembly of this type is generally formed in a configuration which is complimentary to that of the recess but in a slightly smaller dimension than the recess. Accordingly, by assembling a quantity of an extrudable metal in the recess and then advancing the punch into the recess with an extremely high force, it is possible to liquify the extrudable metal. Further, since a liquified metal under extremely high pressure always follows a path of least resistance, it is possible to extrude the metal outwardly from the recess along the sides of the punch to form a thin-walled metal tube.

While the previously known metal extrusion techniques of the above described type have generally been found to be effective for forming extruded tubular metal containers having flat end walls, conical end walls, or conical end walls with projections thereon, heretofore it has generally not been possible to form extruded tubular metal containers having substantially flat end walls and projections which extend outwardly from the end walls thereof. In this regard, it is generally recognized that containers having conical end walls or even containers, such as dispenser tubes, having conical end walls with threaded terminal projections thereon, can be effectively formed utilizing correspondingly formed extrusion dies and punches. However, this is because the angular end walls of the dies and the complimentary angular end walls of the punches utilized for extrusion operations of this type are capable of cooperating to cause liquified metal to flow along the angular surfaces of the punches and dies. Accordingly, when utilizing punches and corresponding dies having angular end walls it is possible to cause metal to flow into terminal cavities in the dies in addition to causing liquified metal to flow outwardly along the cylindrical surfaces of the respective punches. However, when forming containers having substantially flat end walls which are substantially perpendicular to the cylindrical side walls thereof, liquified metals tend to more readily flow outwardly along the cylindrical surfaces of punches rather than into terminal cavities in corresponding dies. This is particularly true when forming tubular members having relatively high side wall thickness, such as those having side wall thickness of greater than approximately 0.01 inch due to the increased spacing required between punches and the respective dies therefore. Accordingly, because of the tendency of highly pressurized liquified metals to inherently seek paths of least resistance, which, when utilizing dies having flat end walls, is outwardly along the sides of the punches thereof, heretofore it has not been possible to form projections or the like on the end walls of extruded metal containers having substantially flat end walls which are perpendicular to the respective side walls thereof.

The instant invention provides an effective method and apparatus for forming extruded metal containers having tubular side walls, substantially flat end walls which are substantially perpendicular to the respective side walls thereof and integrally formed projections which extend outwardly from the respective end walls thereof. More specifically, in accordance with the method of the instant invention, a cylindrical extruded metal tube having a closed end wall which is substantially perpendicular to the side wall thereof and having a projection which extends integrally from the end wall is formed by first assembling an extrudable metal disc in a recess in a die. The recess is formed in a configuration which is complimentary to the terminal end portion of the desired tube, and hence, it has a side wall, a substantially flat end wall which is substantially perpendicular to the side wall and a cavity which is positioned and configured to correspond to the position and configuration of the desired terminal projection on the metal tube. The cavity preferably also has a vent hole therein for venting gases formed or displaced from the recess in the die during an extrusion process. The next step in the method comprises applying a substantially cylindrical punch to the disc in the recess in order to liquify the metal in the disc and to extrude the liquified metal outwardly along the sides of the punch and also into the cavity. The punch utilized in the method has a longitudinally extending side wall and an end face including a peripheral portion which is substantially symmetrical about the axis of the punch. The peripheral portion is formed at an angle of between approximately 10° and 20° relative to a plane which is perpendicular to the axis of the punch so that the peripheral portion of the end wall of the punch angles outwardly and backwardly relative to the center portion of the end wall. The peripheral portion of the end wall merges with a slightly enlarged outer rim portion formed at the terminal end of the side wall of the punch. The outer rim portion has a diameter which is less than the diameter of the recess in the die by an amount equal to the desired thickness of the side wall of the tubular member formed by the method. The punch is applied to the metal disc in the recess in the die with a sufficient force to liquify the metal in the disc and to extrude the liquified metal outwardly between the rim portion of the punch and the side wall of the die so that the metal passes upwardly along the longitudinal extent of the punch. However, because of the angular configuration of the peripheral portion of the end wall of the punch, a certain amount of the liquified metal from the extrudable disc is also extruded into the cavity in the die to form an integral projection on the end wall of the tubular member.

The method of the subject invention is preferably carried out utilizing a punch having a center portion which is preferably substantially perpendicular to the axis of the punch, and the peripheral portion extends angularly outwardly from the center portion. Further, the cavity in the die preferably has a generally tapered triangular configuration, and it includes a pair of spaced side faces which converge slightly in their outward extents.

Accordingly, it is seen that the instant invention provides an effective method and apparatus for forming an extruded tubular metal container having a substantially flat end wall and a projection which extends integrally from the end wall. In this regard, while it is recognized that it is generally impossible to form an extruded tubular metal container having a substantially flat end wall and a projection which extends outwardly from the end wall by conventional extrusion techniques which utilize both punches and dies having substantially flat end walls thereon, it has now been found that it is possible to form a tubular container of this type utilizing a punch having an end wall which includes an angularly disposed peripheral portion and a die having a substantially flat end wall. Specifically, it has been found that by utilizing a die and punch assembly of this type it is possible to extrude a certain quantity of the extrudable liquified metal which would normally flow outwardly between the side walls of the punch and the die so that the metal instead passes into a cavity formed in the end wall of the die. In this regard, it has generally been found that as the angle of the peripheral portion of the end wall of a punch is decreased, the amount of force required to force metal into a cavity in the recess in a die is increased, and that it is virtually impossible to force metal into a terminal cavity when the angle of the peripheral portion of the punch is significantly less than approximately 10°. On the other hand, as the angle of the end portion of the end wall of a punch is increased beyond approximately 20°, the thickness of the peripheral portion of the end wall of a container formed by the method becomes so great that increased material costs make the method impractical.

Accordingly, it is primary object of the instant invention is to provide a method of forming an extruded tubular member having a substantially flat end wall and an integrally formed projection on the end wall.

Another object of the instant invention is to provide a punch and die assembly for forming an extruded tubular member having a substantially flat end wall and a projection which extends outwardly from the end wall.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
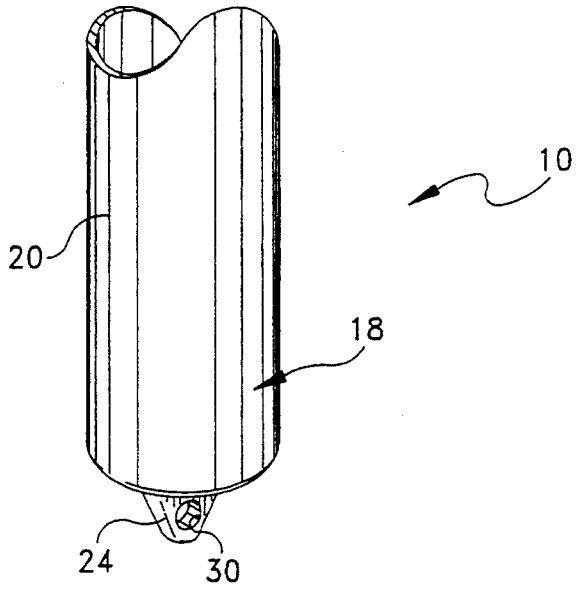
FIG. 1 is a perspective view of an extruded metal tube made by the method of the instant invention.
Figure 2:
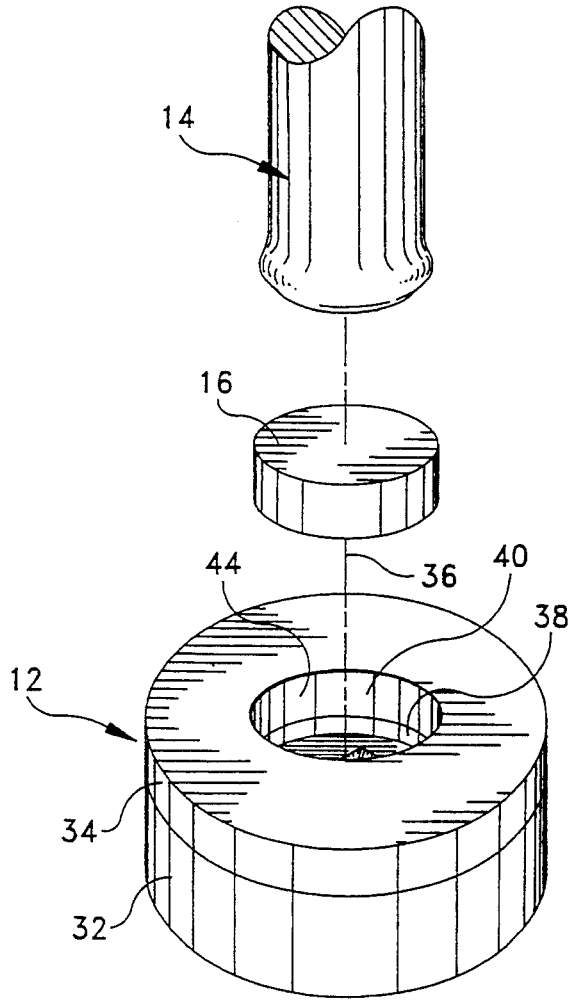
FIG. 2 is a perspective view of the apparatus of the instant invention as it is used in the method.

Referring now to the drawings, the apparatus of the instant invention is illustrated in FIG. 2 through 5 and generally indicated at 10. The apparatus 10 comprises a die assembly generally indicated at 12 and a punch generally indicated at 14. The apparatus 10 is operative for compressing a metal disc 16 in the die assembly 12 with sufficient force to liquify the metal in the disc 16 so that it is extruded between the punch 14 and the die assembly 12 to form a tubular member of the type illustrated in FIG. 1 and generally indicated at 18.

The disc 16 preferably comprises an extrudable metal, such as a conventional extrudable aluminum alloy, and it contains a sufficient quantity of metal to form the tubular member 18 in a desired length. Further, the disc 16 is formed in a circular configuration which is adapted to be received in the die assembly 12 in the manner illustrated in FIGS. 3 through 5.

The tubular member 18 comprises a tubular side wall portion 20, an end wall 22 and a projection 24 which extends integrally from the end wall 22. The end wall 22 preferably has an outer surface 26 which is substantially perpendicular to the longitudinal axis of the tubular member 18, although the inner surface of the end wall 22 includes a slightly angled peripheral portion 28, as will hereinafter be more fully set forth. The tubular member 18, as herein embodied, is adapted to be utilized as a tear gas canister, and the side wall portion 20 preferably has a thickness of between approximately 0.012 inch and approximately 0.014 inch. The projection 24 is preferably formed in a generally triangular configuration and it has a centrally located transverse aperture 30 therethrough which is formed after the extrusion process has been completed.

The die assembly 12 comprises a lower die portion 32 and an upper ring portion 34. The die assembly 12 has a central longitudinal axis 36 which defines a central axis of a lower recess portion 38 formed in the lower die portion 32 and an upper recess portion 40 formed in the upper die portion 34. The lower recess portion 38 has a bottom wall 42 which is substantially perpendicular to the axis 36, and the lower and upper recess portions 38 and 40 cooperate to define a substantially cylindrical recess side wall 44 which is substantially parallel to the axis 36. A cavity 46 extends downwardly from the lower recess portion 38 and is formed to correspond to the configuration and dimension of the projection 24. A vent passage 48 extends downwardly from the cavity 46 for venting gasses which are trapped or formed in the lower recess portion 38 during an extrusion process. The lower die portion 32 and the upper ring portion 34 are made from a suitable metal, such as a high quality steel, which has sufficient strength and a sufficiently high melting point so that the die assembly 12 is not damaged during an extrusion operation.

Figure 3:
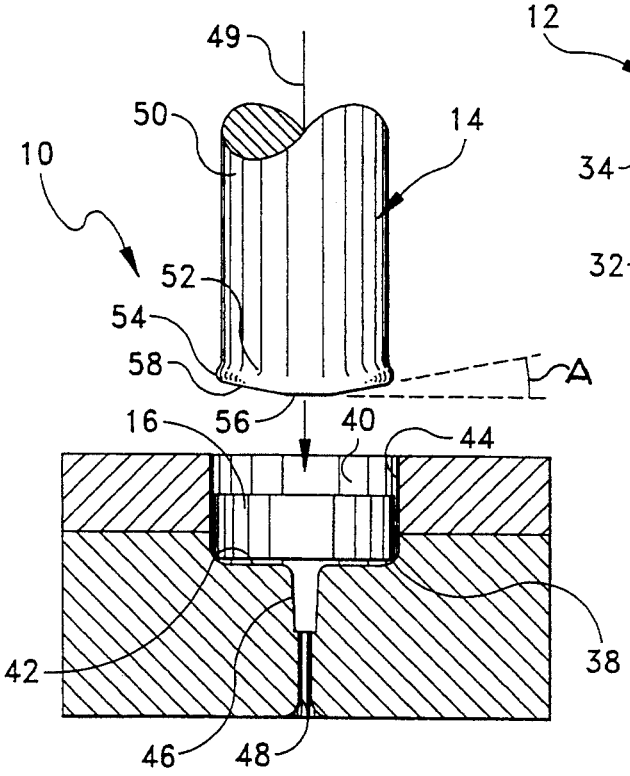
FIGS. 3 through 5 are sequential sectional views of the apparatus as it is used in the method.
Figure 4:
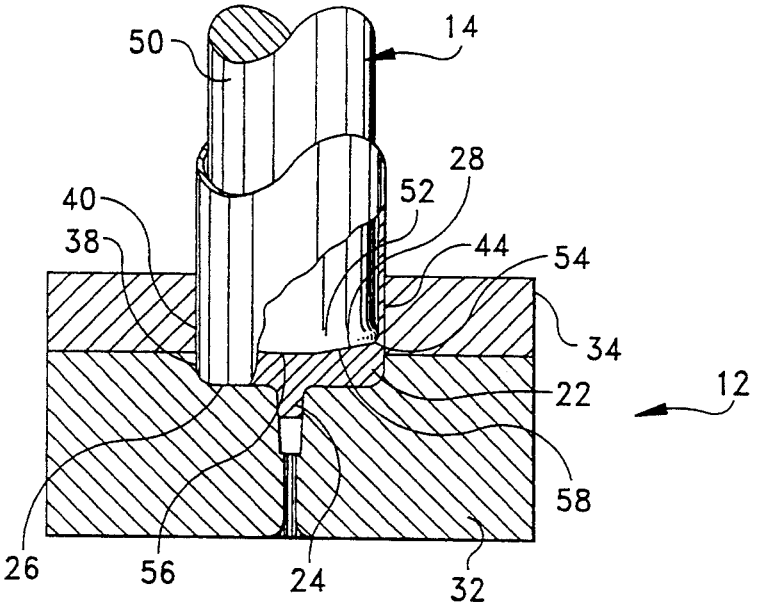
Figure 5:
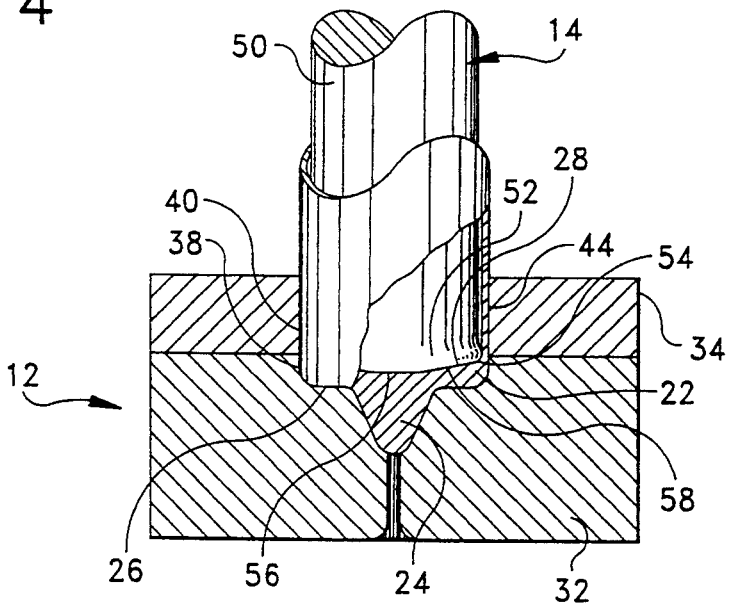
Figure 6:
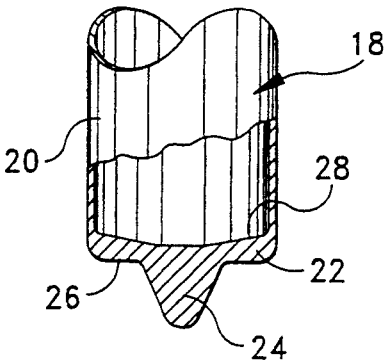
FIG. 6 is a fragmentary elevational view of a tube shown in partial section as made by the method.

The punch 14 has a longitudinal axis 49 and it includes a main shaft portion 50 and a terminal end portion 52. The shaft portion 50 is substantially cylindrical, and it extends in substantially parallel relation to the axis 49. The terminal end portion 52 includes a peripheral rim portion 54 having a diameter which is slightly greater than that of the shaft portion 50. The terminal end portion 52 further includes a central end wall portion 56 which is disposed in substantially perpendicular relation to the axis 49 and a peripheral end wall portion 58 which is disposed in angular relation to the central portion 56. As illustrated in FIG. 3, the peripheral portion 58 is substantially symmetrical about the axis 49, but it extends angularly outwardly and backwardly at an angle A of approximately 15° until it merges with the peripheral rim portion 54. In this regard, it has been found that 15° is the preferred angle A for the peripheral portion 58, although the peripheral portion 58 can alternatively be formed at angles within a range of between approximately 10° and 20°. However, it has been further found that when the peripheral portion 58 is formed at an angle of less than approximately 10°, substantially all of the metal from the metallic disc 16 is extruded upwardly along the side wall of the main shaft portion 50, and a sufficient quality of metal to fill the cavity 46 does not normally flow into the cavity 46.

Accordingly, for use of the die 12 and the punch 14 to form the tube 18 the upper ring portion 34 is assembled on the lower die portion 32, and the disc 16 is assembled in the lower recess portion 38 in the lower die portion 32. The punch 14 is then lowered into the lower recess portion 38 with a sufficient force to liquify the metal in the disc 16. Normally, a pressure of at least approximately 500,000 PSI is required to effectively liquify the metal in the disc 16 so that the metal therefrom is extruded between the punch 14 and the die assembly 12 to form the tubular member 18. In any event, as the punch 14 is lowered into the recess defined by the die assembly 12, liquified metal from the disc 16 is extruded between the rim portion 54 and the perimeter wall of the recess portion 38. As metal from the disc 16 is extruded in this manner, it passes upwardly in the form of a thin shell around the main shaft portion 50. Further, because the pressure on the metal from the disc 16 is relieved as soon as it passes by the rim portion 54, the metal immediately solidifies to form a hard metal tube which is actually spaced outwardly slightly from the main shaft portion 50 by effect of the rim portion 54. Hence the finished tubular member 18 can be easily released from the punch 14. Further, as the punch 14 is advanced into the lower recess portion 38 in the lower die portion 32, a certain amount of the liquified metal from the disc 16 is forced downwardly into the cavity 46 as a result of the angular configuration on the peripheral portion 58. Still further, as the metal is extruded downwardly into the cavity 46, gases generated during the extrusion process or gases trapped in the die assembly 12 are vented outwardly through the vent 48. Once the punch 14 has been advanced a sufficient distance into the die 12 to form the bottom wall 22 in a desired thickness, the punch 14 is removed from the die assembly 12 leaving the tubular member 18 therein. The tubular member 18 can then be removed from the recess in the die assembly 12 by conventional means, such as by passing a probe upwardly through the vent 48. Thereafter, the aperture 30 is formed in the projection 24 by conventional means, and the tubular member 18 is further finished by conventional means as needed.

It is seen therefore that the instant invention provides an effective method and apparatus for forming an extruded tubular metal container having a projection on the terminal end thereof. In this regard, it has been found that by forming the peripheral surface 58 in an angular configuration, it is possible to extrude metal from the disc 16 into the cavity 46, even though the path of least resistance normally causes the metal to extrude upwardly along the sides of the punch 14. Hence, it is seen that the method and apparatus of the instant invention represent significant advancements in the art relating to metal extrusion which have substantial commercial significance.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of forming a cylindrical extruded metal tube having predetermined inner and outer dimensions and configurations and including a tubular side wall having a thickness, a closed end wall which is substantially perpendicular to said side wall and a projection extending integrally outwardly from said end wall, said method comprising:

a. assembling an extrudable metal disc in a recess in a female die, said recess having a side wall having a diameter and including a main portion having a configuration which is complementary to a portion of said tube which includes said closed end wall thereof and an adjacent portion of said tubular side wall thereof, said configuration complementary to said closed end wall of said tube including a substantially flat annular portion, said recess also including an outwardly vented cavity portion having a configuration which is complementary to said projection and being correspondingly positioned thereto and located to extend from a central area of said annular portion; and b. applying a substantially cylindrical punch to said disc in said recess, said punch having a longitudinal axis and comprising a longitudinally extending side wall and an end face including a peripheral portion which is substantially symmetrical about said axis, said peripheral portion extending outwardly relative to said axis and backwardly in a direction along the longitudinal extent of said punch at an angle of between 10° and 20° relative to a plane which is perpendicular to said axis, said peripheral portion extending to and merging with an outer rim portion which defines a maximum diameter of said punch, said maximum diameter being less than the diameter of said side wall of said recess by an amount equal to said thickness, said outer rim portion merging with said longitudinally extending side wall of said punch, said longitudinally extending side wall of said punch having a diameter which is less than said maximum diameter, said punch being applied to said disc with a force sufficient to extrude metal from said disc between said rim portion and said side wall of said recess in a longitudinal direction relative to said punch and to force metal from said disc into said cavity.

2. In the method of claim 1, said end face of said punch including a center portion which intersects said axis in substantially perpendicular relation, said center portion extending outwardly to said peripheral portion.

3. In the method of claim 1, said projection having an outwardly tapering generally triangular peripheral configuration and including a pair of spaced side faces.

4. In the method of claim 1, said metal disc comprising an aluminum alloy disc.

5. In the method of claim 1, removing said tube from said die and said punch and providing a hole through the said projection of said tube perpendicular to said longitudinal axis.

6. An apparatus for forming an extruded cylindrical metal tube, said tube having predetermined inner and outer dimensions and configurations and including a tubular side wall having a thickness, a closed end wall and a solid projection extending integrally from said end wall, said apparatus comprising:

a. a female die having a recess therein, said recess having a configuration which is complementary to an outwardly facing portion of said tube which includes said closed end wall thereof and an adjacent portion of said tubular side wall thereof, said configuration complementary to said closed end wall of said tube including a substantially flat annular portion, said recess also including an outwardly vented cavity portion having a configuration which is complementary to said projection and being correspondingly positioned thereto and located to extend from a central area of said annular portion; and b. a substantially cylindrical punch, said punch having a longitudinal axis and including a longitudinally extending side wall and an end face including a peripheral portion which is substantially symmetrical about said axis, said peripheral portion extending outwardly relative to said axis and backwardly in a direction along the longitudinal extent of said punch at an angle of between 10° and 20° relative to a plane which is perpendicular to said axis, said peripheral portion extending to and merging with an outer rim portion which defines a maximum diameter of said punch, said maximum diameter being less than the diameter of said side wall of said recess by an amount equal to said thickness, said outer rim portion merging with said longitudinally extending side wall of said punch, said longitudinally extending side wall of said punch having a diameter which is less than said maximum diameter.

7. In the apparatus of claim 6, said end face further including a center portion which intersects said axis in substantially perpendicular relation, said center portion extending outwardly to said peripheral portion.

8. In the apparatus of claim 6, said projection having an outwardly tapering generally triangular configuration and including a pair of spaced side faces.

9. In the apparatus of claim 8, said cavity being of generally triangular configuration and including an apex, said die including a vent passage extending outwardly from substantially the apex of said cavity.

* * * * *